US008392715B2

(12) United States Patent
Massicot et al.

(10) Patent No.: US 8,392,715 B2
(45) Date of Patent: Mar. 5, 2013

(54) METHOD AND DEVICE FOR IDENTIFYING OBJECTS OR DOCUMENTS

(75) Inventors: Jean-Pierre Massicot, Rueil-Malmaison (FR); Alain Foucou, Rueil-Malmaison (FR); Zbigniew Sagan, Rueil-Malmaison (FR)

(73) Assignee: Advanced Track and Trace, Rueil-Malmaison (FR)

( * ) Notice: Subject to any disclaimer, the term of this patent is extended or adjusted under 35 U.S.C. 154(b) by 475 days.

(21) Appl. No.: 12/598,077

(22) PCT Filed: Apr. 22, 2008

(86) PCT No.: PCT/FR2008/000563

§ 371 (c)(1), (2), (4) Date: Mar. 29, 2010

(87) PCT Pub. No.: WO2008/142307

PCT Pub. Date: Nov. 27, 2008

(65) Prior Publication Data

US 2012/0144503 A1 Jun. 7, 2012

(30) Foreign Application Priority Data

Apr. 27, 2007 (FR) ..... 07 03146

(51) Int. Cl.
*H04L 9/32* (2006.01)

(52) U.S. Cl. ..... 713/176; 713/166; 726/30; 726/27; 726/26; 399/366

(58) Field of Classification Search ..... 726/29–32; 713/176; 358/1.14; 283/72, 113–114; 399/366
See application file for complete search history.

(56) References Cited

U.S. PATENT DOCUMENTS 5,790,703 A * 8/1998 Wang ..... 358/3.28
6,505,179 B1 * 1/2003 Kara ..... 705/50

(Continued)

FOREIGN PATENT DOCUMENTS

EP 0 889 448 1/1999
WO 01/43086 6/2001

(Continued)

OTHER PUBLICATIONS

Zhao Ling, Morphology Screen Coding anti-counterfeiting method, Mar. 21, 2008, SpringerLink, vol. 4, pp. 371-374.*

(Continued)

*Primary Examiner* — Nathan Flynn
*Assistant Examiner* — Viral Lakhia
(74) *Attorney, Agent, or Firm* — Young & Thompson

(57) ABSTRACT

The document identification method comprises:
- a step of marking the document with an anti-copy mark that is identical for a plurality of documents,
- a step of reading an anti-copy mark,
- a step of generating an identification mark that can vary from one document to another and according to the reading of the anti-copy mark and
- a step of marking said document to form said identification mark on said document.

In embodiments the method comprises, in addition, a step of printing a uniform area and the step of marking the document to form the identification mark comprises a step of emitting light with a laser in the uniform area.
In embodiments the method comprises, in addition, a step of invisibly marking the identification mark on said document.

20 Claims, 3 Drawing Sheets

U.S. PATENT DOCUMENTS

| | | | | |
|---|---|---|---|---|
| 6,721,440 | B2 * | 4/2004 | Reed et al. | 382/100 |
| 7,184,569 | B2 * | 2/2007 | Lawandy et al. | 382/100 |
| 8,055,910 | B2 * | 11/2011 | Kocher et al. | 713/193 |
| 8,059,858 | B2 * | 11/2011 | Brundage et al. | 382/100 |
| 2002/0080995 | A1 * | 6/2002 | Rhoads | 382/100 |
| 2002/0168085 | A1 * | 11/2002 | Reed et al. | 382/100 |
| 2004/0079800 | A1 * | 4/2004 | Sugino et al. | 235/436 |
| 2004/0158724 | A1 * | 8/2004 | Carr et al. | 713/186 |
| 2005/0010776 | A1 * | 1/2005 | Kenen et al. | 713/176 |
| 2005/0021474 | A1 * | 1/2005 | Geist et al. | 705/63 |
| 2007/0016790 | A1 * | 1/2007 | Brundage et al. | 713/176 |
| 2007/0091377 | A1 * | 4/2007 | Smith | 358/3.28 |
| 2009/0261158 | A1 * | 10/2009 | Lawson | 235/379 |

FOREIGN PATENT DOCUMENTS

| | | |
|---|---|---|
| WO | 2006/053685 | 5/2006 |

OTHER PUBLICATIONS

International Search Report dated Dec. 22, 2008, from corresponding PCT application.

* cited by examiner

METHOD AND DEVICE FOR IDENTIFYING OBJECTS OR DOCUMENTS

This invention concerns a process and a device for identifying objects or documents. It applies in particular to the traceability of objects and the fight against counterfeiting.

There are identification processes that consist of applying an identification code to each object to be identified, for example in the form of a bar code. However, this code is easy to recopy and enables counterfeiting by slavish reproduction, whatever the complexity of the code used for representing the original information.

There are also anti-copy marking processes through which a mark is formed, for example by printing a "digital watermark" (in French a "filigrane numérique") concealed in an image or a matrix of contrasted dots printed in a very small size, a mark that, if it is copied, presents a degradation that can be detected. However, for static means of marking (in which the image or dot matrix cannot vary with each print), these marks do not allow each object to be identified individually.

The aim of the present invention is to remedy these drawbacks.

To this end, the present invention envisages, according to a first aspect, a process for identifying documents, that comprises:

a step of marking the document with an anti-copy mark that is identical for a plurality of documents, a step of reading an anti-copy mark, a step of generating an identification mark that can vary from one document to another and according to the reading of the anti-copy mark and a step of marking said document to form said identification mark on said document.

Thanks to these provisions, each product has a unique identification. In addition, the identification mark's line of dependence with the anti-copy mark can be verified. Conversely, any copy of this document is detectable in two ways: for slavish copies, as a result of the anti-copy mark's deterioration and, for copies by reproduction, as a result of the disappearance of the line of dependence between the anti-copy mark and the identification mark.

According to particular features, the process, as described in brief above, comprises a step of printing a uniform area and the step of marking the document to form the identification mark comprises a step of emitting light with a laser in the uniform area.

Thanks to these provisions, the marking of the identification mark is rapid and precise, and does not require the use of a printer on the production line.

According to particular features, the step of marking the document comprises a step of detecting the uniform area's arrival in front of said laser.

Thanks to these provisions, the marking of the identification mark can be realized on a machine independent of the print chain with which the anti-copy mark and the uniform area are realized.

According to particular features, a random or pseudo-random number is utilized during the step of generating the identification mark.

According to particular features, the process that is the subject of the present invention, as described in brief above, comprises, in addition, a step of invisibly marking the identification mark on said document.

According to particular features, the process that is the subject of the present invention, as described in brief above, comprises, in addition, a step of reading the identification mark and a step of verifying the quality of the identification mark read.

Thanks to these provisions, the quality of each document is verified and all distributed documents benefit from the protection provided by utilizing this invention.

According to particular features, the identification mark is of a textual type, i.e. readable by human beings. Inputting and interpreting the identification mark are thus facilitated.

According to particular features, the identification mark also has an anti-copy property. The document's security is thus strengthened.

This invention envisages, according to a second aspect, a document identification device, that comprises:

a means for reading an anti-copy mark formed on a document, a means for generating an identification mark that can vary from one document to another and according to the reading of the anti-copy mark and a means for marking said document to form said identification mark on said document.

This invention envisages, according to a third aspect, a process for verifying the identification of documents, that comprises:

a step of reading an anti-copy mark formed on a document, a step of reading, on said document, an identification mark that can vary from one document to another and a step of determining whether the anti-copy mark and the identification mark present a pre-determined relationship.

This invention envisages, according to a fourth aspect, a device for verifying the identification of documents, that comprises:

a means for reading an anti-copy mark formed on a document, a means for reading, on said document, an identification mark that can vary from one document to another and a means for determining whether the anti-copy mark and the identification mark present a pre-determined relationship.

As the particular characteristics, advantages and aims of this identification device, this identification verification process and this identification verification device are similar to those of the identification process that is the subject of this invention, as described in brief above, they are not repeated here.

Other advantages, aims and characteristics of the present invention will become apparent from the description that follows, made, as an example that is in no way limiting, with reference to the drawings included in an appendix, in which.

Figure 1:
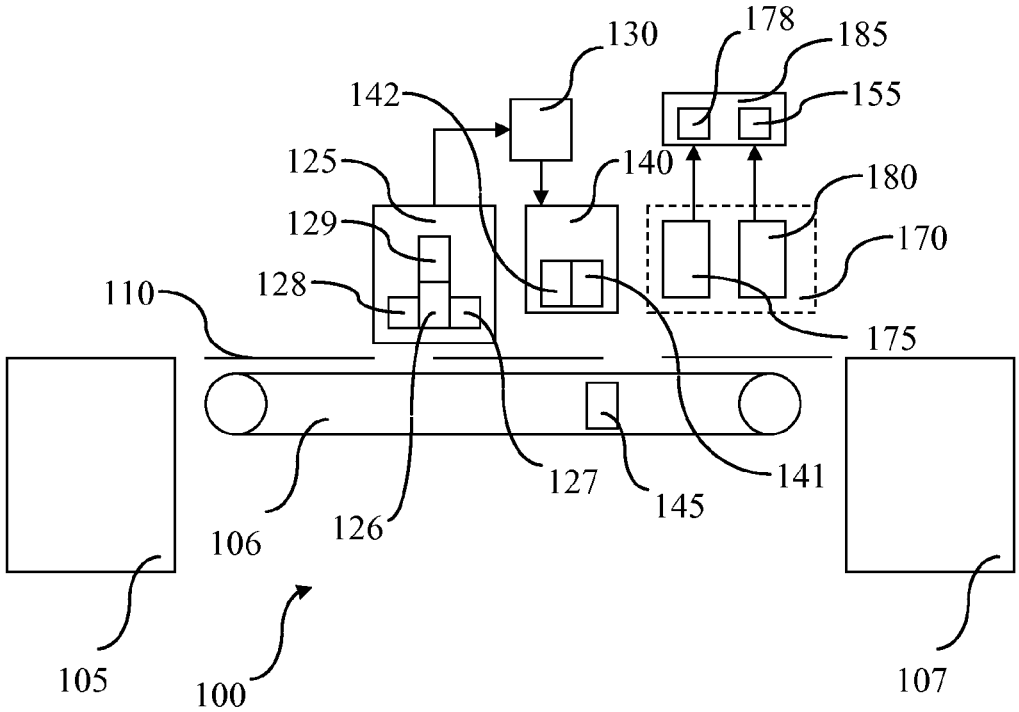
FIG. 1 represents, schematically and in a side view, a particular embodiment of the device that is the subject of this invention.

Before giving the details of the various particular embodiments of this invention, the definitions that will be used in the description are given below.

"information matrix": this is a machine-readable physical representation of a message, generally affixed on a solid surface (unlike watermarks or digital watermarks, which modify the values of the pixels of a design to be printed).

The information matrix definition encompasses, for example, 2D bar codes, one-dimensional bar codes and other less intrusive means for representing information, such as "Dataglyphs" (data marking);

"cell": this is an element of the information matrix that represents a unit of information;

"document": this is any (physical) object whatsoever bearing an information matrix;

"marking" or "printing": any process by which a digital image (including an information matrix, a document, etc) is represented in the real world, this representation generally being made on a surface: this includes, in a non-exclusive way, ink-jet, laser, offset and thermal printing, and also embossing, laser engraving and hologram generation. More complex processes are also included, such as molding, in which the information matrix is first engraved in the mold, then molded on each object (note that a "molded" information matrix can be considered to have three dimensions in the physical world even if its digital representation only comprises two dimensions). It is also noted that several of the processes mentioned include several processing actions, for example standard offset printing (unlike "computer-to-plate" offset), including the creation of a film, said film being used to create a plate, said plate being used in the printing. Other processes also allow an item of information to be printed in the non-visible domain, either by using frequencies outside the visible spectrum, or by inscribing the information inside the surface, etc, and "capture": any process by which a digital representation of the real world is obtained, including the digital representation of a physical document containing an information matrix.

By way of introduction to the description of particular embodiments of the process and device that are subjects of the present invention, it is noted that the result of the degradation of an information matrix is that certain cells cannot be correctly decoded.

Each step in creating the information matrix is carried out with the aim of the original message being readable without error, even if, and this is a wished-for effect, the initial reading of the information matrix is marred by errors. In particular, one of the aims of this information matrix creation is to use the number or rate of errors of encoded, replicated, swapped or scrambled messages in order to determine the authenticity of a mark of the information matrix and therefore of the document that bears it.

In effect, the rate of this degradation can be adjusted according to print characteristics, such that the production of a copy gives rise to additional errors, resulting in an error rate that is, on average, higher when a copy is read than when an original is read.

In order to understand why measuring the message's error rate can be sufficient to determine whether a document is an original or a copy, an analogy with communications systems can be useful. In effect, the passage of the encoded, scrambled message to the information matrix that represents it is none other than a modulation of the message, this modulation being defined as the process by which the message is transformed from its original form into a form suitable for transmission over a channel. This communications channel, namely the information transmission medium that links the source to the recipient and allows the message to be transported, differs depending on whether the captured information matrix is a captured original information matrix or a captured copied information matrix. The communications channel can vary: thus the "communications channel of an original" and the "communications channel of a copy" are differentiated. This difference can be measured in terms of the signal/noise ratio, this ratio being lower for a captured copied information matrix.

The coded message extracted from a captured copied information matrix will have more errors than the coded message extracted from a captured original information matrix. The number or rate of errors detected is, in accordance with this invention, used to distinguish a copy from an original.

FIG. 1 shows an embodiment of the identification device 100 that is the subject of this invention adapted to a machine processing documents that may have been printed at other sites or on other dates. In other embodiments, this device 100 that is the subject of this invention is adapted to a print chain and processes the documents from their initial printing.

Figure 4:
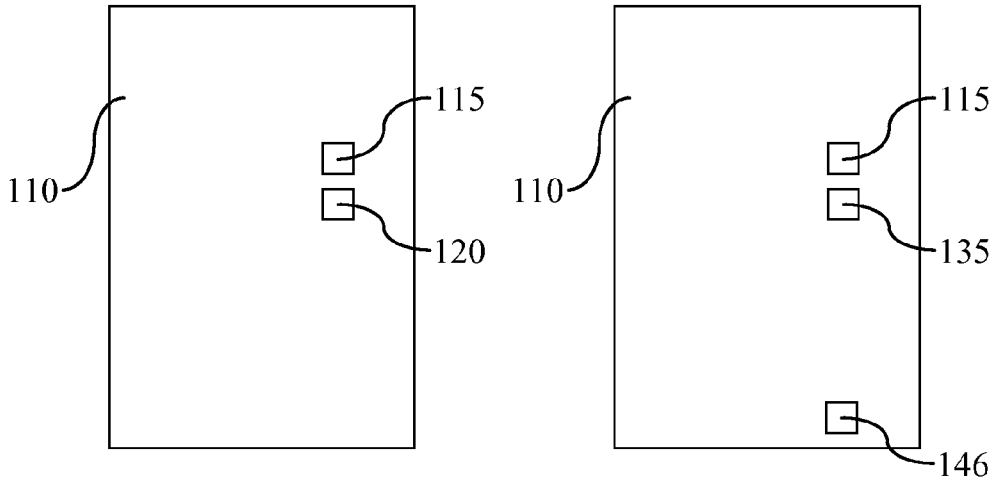
FIG. 4 represents, schematically, an example of a document realized by the utilization of the process or device that are subjects of this invention.

The document identification device 100 comprises:

an unstacker 105, known per se, which unstacks documents 110 (see FIG. 4) bearing, firstly, an anti-copy mark 115, generally identical on all the documents 110, and, secondly, a printed area 120, generally of a uniform color, for example black, a conveyor 106, of known type, a stacker 107, which makes a stack of the documents 110 processed by the device 100, a means 125 for reading the anti-copy mark 115 formed on each document 110, a means 130 for generating an identification mark 135, which can vary from one document to another and according to the reading of the anti-copy mark 115 and a means 140 for marking each document 110 to form said identification mark 135 corresponding, individually, to said document 110.

FIG. 1 also shows a device 170 for verifying the identification of documents 110, that comprises:

a means 175 for reading the anti-copy mark 115 formed on each document 110, a means 180 for reading an identification mark 135 and a means 185 for determining whether the anti-copy mark 115 and the identification mark 135 present a pre-determined relationship.

In the case in which this invention is adapted to a print chain, the unstacker 105 is upstream of the print chain and it is only after printing that the documents 110 bear, firstly, an anti-copy mark 115, and, secondly, a printed area 120.

In each of these two case mentioned above, a laser marking area is prepared on the document 110 by printing a tint area 120, for example a black square with dimensions of 3.2 or 5 mm, close to the anti-copy mark 115. This addition is, for example, carried out during the analog print process, for example offset, of the document 110. This print process is carried out at great speed by always reproducing the same image, including the anti-copy mark 115 and the uniform tint area 120, on each document 110. In the case in which the documents are destined to form folders, the documents 110 are next cut one at a time and then transported to the unstacker 105.

The means 125 for reading the anti-copy mark 115 comprises a camera 126 and at least one light source 127, as well as a means for detecting 128 the arrival of a document 110, for example an opto-electronic cell placed on the path followed by the documents, upstream from the reading means 125. In embodiments two light-sensitive cells are utilized, one for detecting the arrival of the document 110 and the other, synchronized by the first, for detecting the arrival of a tint area 120.

The reading means 125 also comprises a means for processing 129 the image captured by the camera 126, which determines characteristics of the image of the anti-copy mark 115. Thus, in order to match the hidden value of the anti-copy mark 115 and an identification mark 135 that is going to be generated individually for each document 110, a vision system dynamically reads the value of the anti-copy mark 115 and then transmits the information to the means for generating 130 the identification mark 135.

In order to ensure the precise positioning of the identification mark in the pre-printed marking area 120, the vision system dynamically calculates the position according to two orthogonal axes and the angular orientation of the area 120, with respect to the axis of the conveyor 106, and supplies these coordinates to the marking means 140.

The means 130 generates an identification mark 135, which can vary from one document to another, and according to the reading of the anti-copy mark 115. In embodiments, the generation means 130 utilizes a random or pseudo-random number for generating the identification mark 135.

As described above, an individual value is inserted into each identification mark 135 and is dependent on the print of the anti-copy mark 115. After reading at least one sub-set of the information of the anti-copy mark 115 (If the reading fails, the document's withdrawal is triggered, as described below), the means 130 generates an identification mark 135 from the sub-set of the information of the anti-copy mark 115 read and, optionally, from a unique code, a time-stamp and/or one or more encryption keys, jointly or separately called "associated value" in the rest of the description.

The associated value, inserted in the identification mark 135, is specific to each identification mark generated. The sequence of steps during the generation and marking of the identification mark 135 associated to the anti-copy mark 115 is, in particular embodiments, as follows:

- capturing an image of a document's anti-copy mark 115,
- reading at least one sub-set of the information of the anti-copy mark 115,
- if the reading fails, the production is stopped since an identification mark associated to the anti-copy mark cannot be generated,
- generating the identification mark 135 from the sub-set of the information of the anti-copy mark 115 read and optional information (unique code, time-stamp and/or one or more encryption key(s)) and
- printing the identification mark 135 on the document bearing the corresponding anti-copy mark 115.

An example of the method for generating the identification mark 135 is given below.

- from sub-set "ICNA" of the information of the anti-copy mark 115, the associated value "VA" is calculated by an associated value calculation function "F", or a function "F'" that optionally uses one or more other parameters designated as "K",
- a timestamp "T" is obtained,
- an identifier "ID" of the machine generating identification marks is obtained,
- a code "IDA", for example of a machine generating random codes, is obtained (In a variant, a serialized code is obtained),
- an encryption key "KCV" of the identification mark is obtained,
- "VA", "T", "ID" and "IDA" are concatenated, preferably in a binary representation, with a "CONC" function in order to obtain the concatenation "C",
- the concatenation "C" is encoded with an "ENCRYPT" encryption function and the encryption key KCV, in order to obtain "CENC",
- the identification mark 135 is constructed, from the encoded concatenation "CENC", by using a "MODCV" variable code modulation function.

Schematically, the steps can be expressed as:

$$VA=F(ICNA) \text{ or } VA=F'(ICNA,K)$$

$$C=CONC(VA,ID,T,IDA)$$

$$CENC=\text{ENCRYPT}(C,KCV)$$

$$CV=\text{MOD } CV(CENC)$$

We now describe the possible choices and the variants for the functions "F", "F'", "CONC", "ENCRYPT" and "MODCV".

With regard to the "F" function, this is, in a non-limiting way, a function that calculates a value "VA" from a value "ICNA" carried by the anti-copy mark 115 or a sub-set of this value. For example, if the value carried by the anti-copy mark 115 has a size of eight bytes, where the last four bytes are not very useful because they contain generic data, and the first four bytes contain an identifier of the anti-copy mark, then these four bytes can simply be assigned to the value "VA". In this case, "VA=ICNA>>32" (>>indicates a bitshift), where "F" is the function ">>32". Alternatively, the "F" function can be a hash function, for example of the type known by the name "SHA-1", "SHA-256" or "MD5". The "F" function therefore calculates the hash of the value carried by the anti-copy mark 115, and if data volume constraints apply, keeps a sub-set of the result, for example the first four bytes.

With regard to the "F'" function, in the case where the "F'" function is used with parameter(s) "K", "F'" can, for example, be an encryption function (for example, known by the name "Triple-DES" or "AES"). "F'" can also be a hash function such as those mentioned previously, in combination with a key, here the parameter "K", which must be kept secret.

In a variant, if an anti-copy mark characterization method is applied to obtain a fingerprint "E", "F" and "F'" are functions of "E" such that VA=F(E, ICNA) and VA=F'(E, ICNA, K)."

With regard to the "CONC" function, the values "VA", "T", "ID", "IDA" can be integers or have a value belonging to a defined set (for example, there are four machines generating identification marks 135, thus there are four possible values for "ID"). In the second case, the number of bits required to represent the set of possible values is defined. In the first, the integers are generally represented over a defined set of bits.

With regard to the "ENCRYPT" function, it can be a symmetric encryption function, for example known by the name "Triple DES", "AES" or "RC4", or an asymmetric encryption function, for example known by the name "RSA".

With regard to the "MODCV" function, this is generally a function generating a two-dimensional bar code, the one-dimensional bar codes having a limited information capacity. It is noted that "Datamatrix" (registered trademark) are high information capacity 2D bar codes, widely used and which, as a result, can be utilized for generating the identification mark 135. The "MODCV" function can also be a function generating a secured information matrix, which requires one or more encryption and scrambling keys. It is noted that, in this case, the "ENCRYPT" function is not necessary, encryption being intrinsic to the generation of the identification mark 135.

In variants, the "MODCV" function is a function generating an uncoded marking, such as a text.

In variants where the "MODCV" function is a function generating a secured information matrix, this information matrix is, in part, naturally degraded during printing such that it has authentication properties.

The means 140 for marking each document 110 to form the identification mark 135 that corresponds individually to this document 110 comprises, in an embodiment, a laser source 141 and at least one galvanometer mirror 142. For preference, the laser source produces a femtosecond laser beam, allowing quicker marking thanks to radiation that is more powerful and that has a higher modulation frequency. In a variant, the laser source 141 is associated to an array optical modulator, or optical valve, for example to a liquid crystal matrix display. It is noted that the laser makes a local abrasion of the ink of the printed tint area 120.

In the embodiment illustrated in FIG. 1, the device 100 comprises, in addition, a means for marking 145 a second identification mark 146 on the document 100, in a position other than the position where the anti-copy mark and identification mark 135 are located, for example on the reverse side of the document 100. For example, for this purpose one uses a low-power laser, with or without pre-printing a uniform area, or an ink that is invisible in the visible field and visible in the infrared field. The second identification mark 146 is, potentially, identical to the first identification mark 135.

In the embodiment illustrated in FIG. 1, the means 180 for reading the identification mark 135, which comprises a camera and at least one light source (not shown), is associated to a means 155 for verifying the quality of the identification mark read and a means (not shown) for withdrawing each document 100 bearing a poor quality identification mark 135. In this way, the quality of each document is verified and all distributed documents benefit from the protection provided by utilizing this invention. The result of the verification carried out by the verification means 180 is transmitted, to be stored and used later, to a supervisor (not shown).

The means for withdrawing each document 100 bearing a poor quality identification mark 135 is, for example, constituted of a "reject gate", i.e. a shutter controlled so that, in one of its positions, the documents fall into a waste bin and, in another position, the documents are let through to the stacker 107.

The means 125 for reading the anti-copy mark 115 formed on a document 115 comprises a camera and at least one light source and is associated to a means for processing 178 the image captured by this camera, which determines characteristics of the image of the anti-copy mark 115, according to techniques known per se in the field of anti-copy markings.

The means 185 for determining whether the anti-copy mark 115 and the identification mark 135 present a predetermined relationship carries out the verification of a document's validity:

- from an image, it reads the identification mark "CV" corresponding to the identification mark 135 "CV",
- with a "DEMOD" function, it processes "CV" to obtain a value "CENC'" corresponding to the value "CENC",
- it carries out a decryption of "CENC'" with a "DECRYPT" function, inverse of the "ENCRYPT" function, and also a decryption key "KCV'", to obtain the decrypted concatenation "C'", corresponding to "C". It is noted that, for symmetric encryption methods, "KCV'" is equal to "KCV", but "KCV" and "KCV'" are different for asymmetric encryption methods.
- it deconcatenates the value "C'" with a "DECONC" function, inverse of the function "CONC", to obtain values "VA'", "ID'", "T'" and "IDA'" corresponding to values "VA", "ID", "T" and "IDA" respectively,
- it reads the content of the anti-copy mark 115 with a "READCNA" function and extracts the value "ICNA",
- it determines whether the anti-copy mark corresponds to an original or a copy, with an "AUTH" function and
- it calculates "VA"=F(ICNA)" or "VA"=F'(ICNA,K)".

There are therefore four case scenarios:

- either "VA"=VA'" and "AUTH(CNA)=ORIG", in which case the document is validated,
- or "VA"=VA'" and "AUTH(CNA)=COPY", in which case the document is a copy of a valid document,
- or "VA"≠VA'" and "AUTH(CNA)=ORIG", in which case the document is a stolen original, on which a non-compliant identification mark 135 "CV" has been affixed,
- or "VA"≠VA'" and "AUTH(CNA)=COPY", in which case the document is a reproduction.

Figure 2:
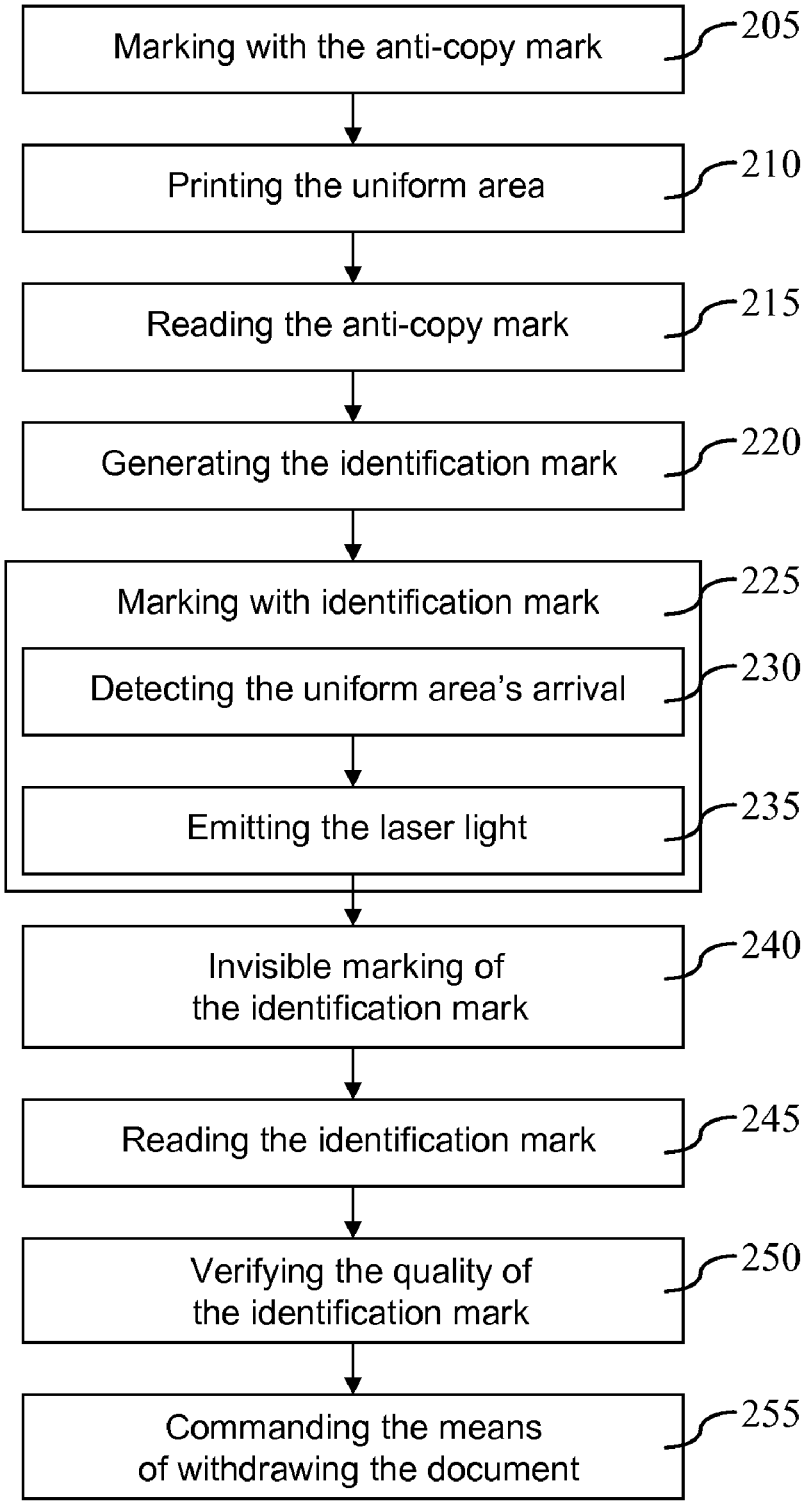
FIG. 2 represents, in the form of a flowchart, steps in a particular embodiment of the identification process that is the subject of this invention.

FIG. 2 shows that the identification process for a document that is the subject of this invention comprises, firstly, a step 205 of marking the document with an anti-copy mark that is identical for a plurality of documents.

At the same time as the step 205, during a step 210, a step of printing a uniform area is carried out.

Then, during a step 215, the anti-copy mark is read. During this step the quality of the anti-copy mark is verified.

During a step 220, an identification mark is generated that can vary from one document to another and according to the reading of the anti-copy mark. For example, a random or pseudo-random number is utilized during the step 220 of generating the identification mark.

During a step 225, the document is marked in order to form the identification mark on said document. Step 225 comprises:

- a step 230 of detecting the uniform area's arrival in front of said laser and
- a step 235 of emitting light with a laser in the uniform area.

During a step 240, the identification mark is invisibly marked on the document.

During a step 245, the identification mark is read and, during a step 250, the quality of the identification mark read is verified.

Depending on the result of the step 250, during a step 255, the document is kept in the production flow or it is withdrawn from the production flow, so that all the identification marks of the documents remaining in the flow are of a sufficiently high quality.

As the content of each of the steps illustrated in FIG. 2 is detailed with respect to FIG. 1, it is not repeated here Thanks to the utilization of the present invention, each document or product has an identification that can be read easily. In addition, the identification mark's line of dependence with the anti-copy mark can be verified. Conversely, any copy of this document is detectable in two ways: firstly, as a result of the anti-copy mark's deterioration and, secondly, as a result of the disappearance of the line of dependence between the anti-copy mark and the identification mark.

In addition, the marking of the identification mark is rapid and precise, and does not require the use of a printer on the production line. It can be realized on a machine independent of the print chain with which the anti-copy mark and the uniform area are realized.

The quality of each document is verified and all distributed documents benefit from the protection provided by utilizing this invention.

Figure 3:
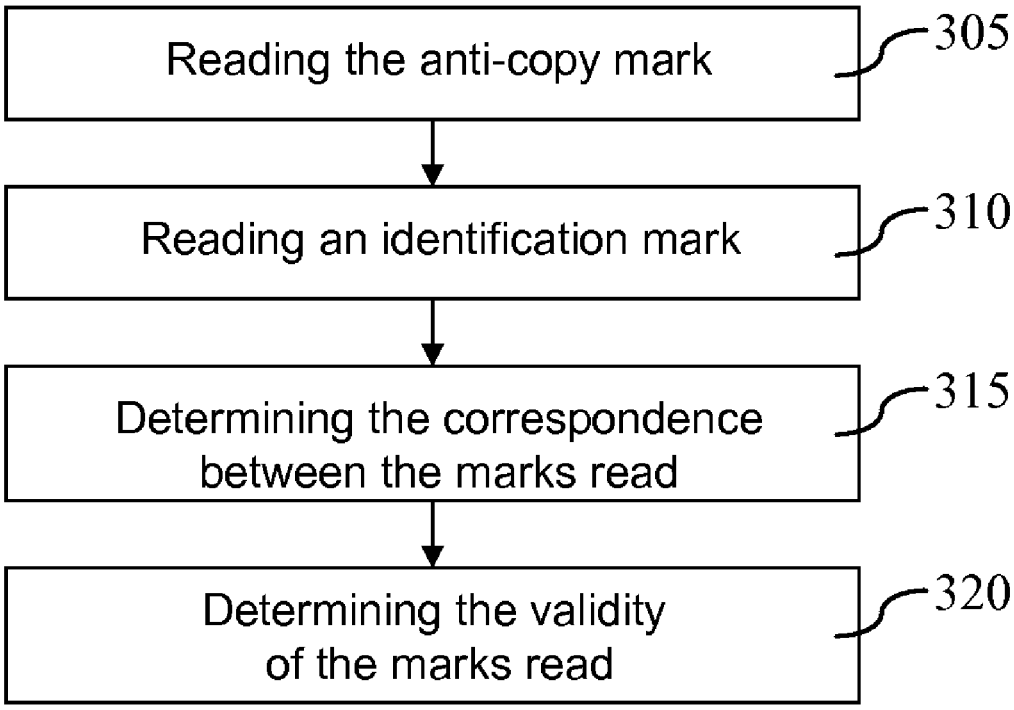
FIG. 3 represents, in the form of a flowchart, steps in a particular embodiment of the identification verification process that is the subject of this invention

FIG. 3 shows that the process verifying a document's identification comprises:

- a step 305 of reading an anti-copy mark formed on a document,
- a step 310 of reading a document's identification mark that can vary from one document to another,
- a step 315 of determining whether the anti-copy mark and the identification mark present a pre-determined relationship and
- a step 320 of determining the validity of the anti-copy mark and the identification mark.

As each of the steps illustrated in FIG. 3 is detailed with respect to FIG. 1, their description is not repeated here.

The invention claimed is:

1. A document identification method, that comprises an identification device executing the sequential steps of:

a step of marking a plurality of documents each with i) a uniform area and ii) an anti-copy mark that is identical for each different document of the plurality of documents, the anti-copy mark comprising a number of different erroneous cells for each of the different documents of the plurality of documents, for each of the different documents, a step of the identification device reading an anti-copy mark to provide information dependent on the erroneous cells, for each of the different documents, a step of the identification device generating an identification mark that varies from one document to another document, each generated identification mark depending on the read erroneous cells of the anti-copy mark of the corresponding document, and for each of the different documents, a step of the identification device marking said document with said generated identification mark to form said identification mark on said document, wherein said marking step comprises emitting light with a laser in the uniform area to form the identification mark.

2. A method according to claim 1, wherein the step of marking the document comprises a step of detecting the uniform area's arrival in front of said laser.

3. A method according to claim 1, wherein a random or pseudo-random number is utilized during the step of generating the identification mark.

4. A method according to claim 1, that comprises, in addition, a step of invisibly marking the identification mark on said document.

5. A method according to claim 1, that comprises, in addition, a step of reading the identification mark and a step of verifying the quality of the identification mark read.

6. A method according to claim 1, wherein the identification mark is of a textual type readable by human beings.

7. A method according to claim 1, wherein the identification mark also has an anti-copy property.

8. A method according to claim 1, wherein the anti-copy mark, when copied, presents a detectable degradation, said detectable degradation changing the erroneous cells the marked identification mark no longer corresponds to the read erroneous cells of the degraded anti-copy mark.

9. A document identification device that comprises:

a device means for reading an anti-copy mark formed on a document, the anti-copy mark comprising cells, including a number of different erroneous cells, the reading of anti-copy mark providing information dependent on the erroneous cells, a means for generating an identification mark that varies from one document to another and is dependent on the read erroneous cells of the anti-copy mark of each respective document, and a laser means for marking said document to form said identification mark on said document, wherein a correspondence between the formed identification mark and the anti-copy mark depends on the erroneous cells of the anti-copy mark.

10. A device according to claim 9, that comprises a means for printing a uniform area, wherein the laser means for marking the document to form the identification mark by emitting light with a laser in the uniform area.

11. A device according to claim 10, wherein the means for marking the document comprises a means for detecting the uniform area's arrival in front of said laser.

12. A device according to claim 9, wherein a random or pseudo-random number is utilized by the means for generating the identification mark.

13. A device according to claim 9, that comprises, in addition, a means for invisibly marking the identification mark on said document.

14. A device according to claim 9, that comprises, in addition, a means for reading the identification mark and a means for verifying the quality of the identification mark read.

15. A device according to claim 9, wherein the identification mark is of a textual type readable by human beings.

16. A device according to claim 9, wherein the identification mark also has an anti-copy property.

17. A method for verifying the identification of documents, that comprises an identification device sequentially executing:

with a reading element, a step of the identification device reading an anti-copy mark formed on a document, the anti-copy mark comprising cells, including a number of different erroneous cells, the reading of the erroneous cells of the anti-copy mark providing information dependent on the erroneous cells, a step of the identification device reading, on said document, a laser-generated identification mark that varies from one document to another, and a step of the identification device determining whether the anti-copy mark and the identification mark present a pre-determined relationship, wherein the pre-determined relationship between the identification mark and the anti-copy mark depends on the erroneous cells of the anti-copy mark.

18. A device for verifying the identification of documents, that comprises:

a first device means for reading an anti-copy mark formed on a document, the anti-copy mark comprising cells, including a number of different erroneous cells, the reading of anti-copy mark providing information dependent on the erroneous cells, a second device means for reading, on said document, an identification mark that varies from one document to another, and a means for determining whether the anti-copy mark and the identification mark present a pre-determined relationship, wherein the pre-determined relationship between the identification mark and the anti-copy mark depends on the erroneous cells of the anti-copy mark on each respective document.

19. The device of claim 18, the anti-copy mark, when copied, presents a detectable degradation, said detectable degradation providing that certain cells cannot be correctly decoded.

20. The device of claim 18, further comprising:

a laser means for generating the identification mark, wherein, the means for reading an anti-copy mark formed on each said document and the means for reading on each said document the identification mark, are arranged to provide input signals to the means for determining whether the anti-copy mark and the identification mark present the pre-determined relationship, and the anti-copy mark, when copied, presents a detectable degradation, said detectable degradation providing that certain cells cannot be correctly decoded and the pre-determined relationship is destroyed.

* * * * *

UNITED STATES PATENT AND TRADEMARK OFFICE

CERTIFICATE OF CORRECTION

PATENT NO. : 8,392,715 B2
APPLICATION NO. : 12/598077
DATED : March 5, 2013
INVENTOR(S) : Massicot et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 630 days.

Signed and Sealed this
First Day of September, 2015

Michelle K. Lee

Michelle K. Lee
*Director of the United States Patent and Trademark Office*